United States Patent [19]

Sepulveda et al.

[11] Patent Number: 4,764,292

[45] Date of Patent: Aug. 16, 1988

[54] FABRIC-SOFTENING PARTICLES

[75] Inventors: Ralph R. Sepulveda, Suffern, N.Y.; John A. Hockey, Ridgewood, N.J.

[73] Assignee: Lever Brothers Company, New York, N.Y.

[21] Appl. No.: 105,969

[22] Filed: Oct. 5, 1987

Related U.S. Application Data

[63] Continuation-in-part of Ser. No. 851,026, Apr. 11, 1986, abandoned.

[51] Int. Cl.[4] ..... D06M 11/00

[52] U.S. Cl. ..... 252/8.8; 252/8.6; 252/528; 252/547

[58] Field of Search ..... 252/8.6, 8.8, 528, 547

[56] References Cited

U.S. PATENT DOCUMENTS

| | | | |
|---|---|---|---|
| 2,805,993 | 9/1957 | Barnard et al. | 252/8.8 |
| 3,862,058 | 1/1975 | Nirschl et al. | 252/528 |
| 3,886,075 | 5/1975 | Bernardino | 252/8.75 |
| 3,936,537 | 2/1976 | Baskerville et al. | 252/8.8 |
| 3,948,790 | 4/1976 | Speakman | 252/8.8 |
| 4,141,841 | 2/1979 | McDanald | 252/8 |
| 4,196,104 | 4/1980 | Oguaha | 252/542 |

FOREIGN PATENT DOCUMENTS

| | | |
|---|---|---|
| 157618 | 9/1985 | European Pat. Off. . |
| 2141152 | 12/1984 | United Kingdom . |

*Primary Examiner*—A. Lionel Clingman
*Assistant Examiner*—Willie J. Thompson
*Attorney, Agent, or Firm*—Honig, Milton L.; James J. Farrell

[57] ABSTRACT

A fabric softening particle is provided comprising a mixture of quaternary ammonium ion-exchanged clay having an ion-exchange capacity of at least about 10 meq/100 gms and preferably about 50 meq/100 gms and a water-insoluble quaternary ammonium salt in the ratio of 1:3 to 3:1. The particle softens more efficiently than either of its components. When incorporated into a detergent powder, detergency is not diminished as would occur when either of the particle components are separately incorporated.

15 Claims, No Drawings

FABRIC-SOFTENING PARTICLES

This is a continuation-in-part application of Ser. No. 851,026, filed Apr. 11, 1986 abandoned.

BACKGROUND OF THE INVENTION

1. Field of the Invention

The invention relates to fabric softening particles suitable for incorporation into detergent powders and a process for preparation of the particles.

2. The Prior Art

Traditionally, fabric softeners in liquid form have separately been added to the wash during the rinse cycle of automatic laundry washing machines. Consumers, however, desire the convenience of single step, single package products. In response, powdered detergents have been developed which incorporate fabric softening components. These formulations in addition to cleaning, soften laundry during the wash cycle. Unfortunately, organic cationic quaternary ammonium salts, the compounds normally used as softening agents, interact adversely with anionic surfactants found in detergent powders. The art has found various means to surmount this problem. One approach has been to substitute the cationic materials with clays capable of softening. Alternatively, organic cationic salts may be utilized when formulated in a manner which separates them from interaction with the deactivating anionic surfactants. A number of patents have combined both approaches. These patents report mixtures of both clay and a protected organic cationic quaternary ammonium salt.

GB 2,141,152A (Ramachandran) discloses a softening composition comprising discrete particles of a smectite-type clay and a detergent surface active agent in the ratio of at least 15:1. An organic cationic salt is then deposited onto the particles and adsorbed into the particle surface. In U.S. Pat. No. 3,936,537 (Baskerville et al.) discrete particles of a fabric softening additive are formulated by combining cationic quaternary ammonium salts with a dispersion inhibitor in the range of 4:1 to 1:4. These particles, called prills, may then be mixed with a granular detergent one of whose components may be a clay. Softening is further improved by the presence of the clay, especially by a mineral called bentonite. Dispersion inhibitors include waxes, polyhydric alcohols, aliphatic carboxylic acids, their esters or alcohols and alkoxylated condensates of the foregoing.

Further refinements of the cationic/dispersion inhibitor prills are described in U.S. Pat. No. 4,141,841 (McDanald). Therein the aforedescribed prills are agglomerated with a builder salt and an organic agglomerating agent to form large granules. Unlike the smaller prills, these particles because of their large size do not separate from the granular detergent mixture. Agglomeration is also an improvement over encapsulation because fabric-softening effectiveness remains high while still preventing inactivation by anionic surfactant.

In U.S. Pat. No. 3,862,058 (Nirschl et al.) and in U.S. Pat. No. 3,886,075 (Bernardino) clay is initially admixed in a crutcher with the detergent, builder and adjunct laundering ingredients. The resulting mixture is then spray-dried to form granules. Quaternary ammonium salt is sprayed onto these granules from a melt. This method of preparation was said to avoid affixing the quaternary salt to the surface of the clay by an ion-exchange mechanism.

By contrast with disclosures found in the foregoing patents, U.S. Pat. No. 3,948,790 (Speakman) reports that the replacement of exchangeable metal ions of clays with certain types of alkylsubstituted ammonium ions results in a material having softening effectiveness. Good performance was found limited to alkyl-substituted ammonium ions of total carbon atom content not exceeding 8.

It has also been well known that quaternary ammonium ion-exchanged organophilic clays are useful in the processing of textiles. For instance, U.S. Pat. No. 2,805,993 (Barnard et al.) discloses the lubricating properties of Bentone 34®, a bentonite whose sodium ions are replaced with dimethyl dioctadecylammonium ions, sold by N.L. Industries, Inc.

From the foregoing review of the art, it is clear that the manner in which one combines quaternary ammonium salts, clays and/or quaternary ammonium ion substituted clays, will have a significant bearing upon fabric softening properties. Some beneficial combinations have been uncovered. It is evident, however, that the optimum combination of these "softener building blocks" has yet to be reported.

An object of this invention is to provide a fabric softening agent more efficient than heretofore known.

A further object of this invention is to provide a fabric softening agent that is compatible with anionic surfactants, does not yellow laundry and does not interfere with detergency or sudsing.

A final object of this invention is to provide detergent compositions incorporating the aforementioned improved fabric softening agent.

SUMMARY OF THE INVENTION

A fabric softening particle is provided comprising:

(i) a clay having an ion-exchange capacity of at least about 10 meq/100 grams, in which clay from about 5 to 100 molar percent of the exchangeable cations are quaternary ammonium ions of the formula $[R_1R_2R_3R_4N]^+$ wherein $R_1$, $R_2$, $R_3$ and $R_4$ are organic radicals selected from the group consisting of $C_1$–$C_{22}$ alkyl, benzyl, $C_{10}$–$C_{16}$ alkyl benzyl, $C_{10}$–$C_{16}$ alkyl phenyl, $C_2$–$C_4$ hydroxyalkyl, cyclic structures in which nitrogen forms part of a ring, and mixtures thereof; and (ii) a water-insoluble quaternary ammonium salt of the formula $[R_1R_2R_3R_4N]^+{}_nX^{n-}$ wherein $R_1$, $R_2$, $R_3$ and $R_4$ are organic radicals as defined above; X can be any salt forming anion; n is an integer from 1 to 3; and the ratio of (i) to (ii) is 3:1 to 1:3.

DETAILED DESCRIPTION OF THE INVENTION

It has been discovered that improved fabric softening can be achieved by particles comprising a quaternary ammonium salt and an organophilic clay that has been metal ion exchanged with quaternary ammonium ions. A critical feature is that the concentration of quaternary ammonium salt to exchanged clay be within the range of about 3:1 to 1:3. Particularly preferred are ratios of about 2:1 to 1:2, and most preferable is a ratio of about 1:1. Such compositions may be conveniently employed during home laundering as additives to the wash.

Furthermore, the present invention contemplates incorporating the above particles into a conventional laundry detergent composition to form a fully-formulated product. Besides the softening particles, the detergent product will contain an organic surfactant, a builder salt and other functional components present in conventional laundry formulations. The addition of such a fully formulated product to water produces a laundering wash liquor capable of providing the desired degree of cleaning and softening of soiled fabrics.

The clay minerals whose exchangeable cations are substituted with quaternary ammonium cations can be described as impalpable, expandable, three-layer clays, i.e., aluminosilicates and magnesium silicates, having an ion exchange capacity of at least 10 meq/100 grams of clay. The term "impalpable" as used to describe the clays employed herein means that the individual clay particles are of a size that they cannot be perceived tactilely. Such particle sizes are, in general, below 50 microns. Preferably, the clays herein will have a particle size within the range of from about 5 microns to 25 microns. The term "expandable" as used to describe clays relates to the ability of the layered clay structure to be swollen, or expanded, on contact with water. The three-layer expandable clays used herein are those materials classified geologically as smectites.

There are two distinct classes of smectite clays. In the first, aluminium oxide is present in the silicate crystal lattice; in the second, magnesium oxide is present in the silicate crystal lattice. The general formulas of these smectites are $Al_2(Si_2O_5)_2(OH)_2$ and $Mg_3(Si_2O_5)(OH)_2$ for the aluminium and magnesium oxide type clay, respectively. The three-layer, expandable aluminosilicates useful herein are further characterized by a dioctahedral crystal lattice, while the expandable three-layer magnesium silicates have a trioctahedral crystal lattice.

The clays, from which the quaternary ammonium ion substituted clays (hereinafter "quat clays") are derived, can contain cationic counterions such as those of hydrogen, sodium, potassium, calcium, and magnesium. It is customary to distinguish between clays on the basis of one cation predominantly or exclusively absorbed. For example, a sodium clay is one in which the absorbed cation is predominantly sodium. Such absorbed cations can become involved in exchange reactions with cations present in aqueous solutions. A typical exchange reaction involving a smectite-type clay is expressed by the following equation:

$$\text{smectite clay (Na)} + NH_4OH = \text{smectite clay } (NH_4) + NaOH$$

One equivalent weight of ammonium ion replaces an equivalent weight of sodium in the foregoing equilibrium reaction. In view thereof, it is customary to measure clay cation exchange capacity (sometimes termed "base exchange capacity") in terms of milli-equivalents per 100 grams of clay (meq/100 grams). Cation exchange capacity of clays can be measured in several ways, including by electrodialysis, by exchange with ammonium ion followed by titration, or by a methylene blue procedure, all as fully set forth in Grimshaw, *The Chemistry and Physics of Clays*, Interscience Publishers, Inc., pp. 264–265 (1971). Cation exchange capacity of a clay relates to such factors as the expandable properties of the clay and the charge of the clay which, in turn, is determined at least in part by the lattice structure. The ion exchange capacity of clays varies widely, from 2 meq/100 grams for kaolinites to 150 meq/100 grams and greater for certain clays of the montmorillonite variety. Illite clays have an ion exchange capacity somewhere in the lower portion of the range, e.g., around 26 meq/100 grams. However, smectites, such as nontronite, having an ion exchange capacity of approximately 50 meq/100 grams, saponite having an ion exchange capacity of about 70 meq/100 grams, and montmorillonite having an ion exchange capacity greater than 70 meq/100 grams, are useful for preparing the present compositions. Accordingly, clay minerals useful herein can be characterized as impalpable, expandable, three-layer smectite clays having an ion exchange capacity of at least 10 meq/100 grams, preferably at least about 30 meq/100 grams, and optimally at least about 50 meq/100 grams.

Smectite clays used in the present invention are commercially available. They include montmorillonite, hectorite, saponite which are preferred and also volchonskoite, nontronite and sauconite. Clays herein are available under commercial names such as Thixogel, Gelwhite GP and, especially, Soft Clark, from Georgia Kaolin Co., Elizabeth, New Jersey; Volclay BO and Volclay No. 325, from American Colloid Company, Skokie, Illinois; Black Hills Bentonite BH 450, from International Minerals and Chemicals; and Veegum Pro and Veegum F, from R. T. Vanderbilt. It is to be recognized that such smectite minerals obtained under the foregoing commercial names can comprise mixtures of the various discrete mineral entities. Such mixtures of the smectite minerals are suitable for use herein.

Quat clays can be made by any suitable method. For instance, they can be prepared by slurrying the untreated clay in a solution containing the quantity of the appropriate quaternary ammonium salt intended to be reacted with the clay, that is to provide the desired degree of ion exchange. The treated clay can then be separated from the liquor by known methods such as filtration or centrifuging. Dry or damp treated clay can be dry mixed with other components of the detergent composition in granular form. Alternatively, it may be slurried with water or with liquid components of the detergent composition, e.g. the nonionic surfactant, and sprayed on or otherwise mixed with the granular components.

For further discussion of the preparation of alkyl ammonium substituted clays generally, see U.S. Pat. No. 2,746,887 to O'Neil patented May 22, 1956 and U.S. Pat. No. 2,531,427 to Hauser patented Nov. 28, 1950, both of which are incorporated by reference.

Quat clays may also be obtained commercially. A particularly preferred example is Bentone 34 ®, which is a montmorillonite clay exchanged with dimethyl di-(hydrogenated) tallow ammonium ions, manufactured by N.L. Industries, Inc.

Ammonium cations exchangeable for the metal ions of the clay to produce quat clays may be derived from salts of the formula $[R_1R_2R_3R_4N]^+{}_nX^{n-}$ wherein $R_1$, $R_2$, $R_3$ and $R_4$ are organic radicals of total carbon atom content exceeding 8 and containing a group selected from $C_1$–$C_{22}$ alkyl, $C_{10}$–$C_{16}$ alkyl phenyl, $C_2$–$C_4$ hydroxyalkyl, cyclic structures in which nitrogen forms part of the ring, and mixtures thereof. Preferably, $R_1$ and $R_2$ represent an organic radical containing a group selected from a $C_{16}$–$C_{22}$ aliphatic radical or an alkylphenyl or alkylbenzyl radical having 10–16 carbon atoms in the alkyl chain, $R_3$ and $R_4$ representing hydrocarbyl groups containing from 1 to 4 carbon atoms, or $C_2$–$C_4$ hydroxyalkyl groups and cyclic structures in which the nitrogen atom forms part of the ring. X is an anion which may be selected from the group consisting of hydroxide, halide, sulfate, methyl sulfate and phosphate. The charge on the anion is designated as n-, where n is 1-3. The number of cationic ammonium groups, n, will equal the charge, n, on the anion to provide electrical neutrality. Quaternary ammonium compounds wherein n is 1 are commercially available and preferred for economic reasons.

In the context of the above definition, the hydrophobic moiety (i.e., the $C_{16-22}$ aliphatic, $C_{10-16}$ alkyl phenyl or alkyl benzyl radical) in the organic radical $R_1$ may be directly attached to the quaternary nitrogen atom or may be indirectly attached thereto through an amide, ester, alkoxy, ether, or like grouping.

The quaternary ammonium salts used in this invention can be prepared in various ways well known in the art. Many such materials are commercially available. The quaternaries are often made from alkyl halide mixtures corresponding to the mixed alkyl chain lengths in fatty acids. For example, the "di-tallow" quaternaries are made from alkyl halides having mixed $C_{14}$–$C_{18}$ chain lengths. Such mixed di-long chain quaternaries are useful herein and are preferred from a cost standpoint.

As noted above, essentially any anionic group can be the counter-ion in the quaternary compounds used herein. The anionic groups in the quaternary compounds can be exchanged, one for another, using standard anion exchange resins. Thus, quaternary ammonium salts having any desired anion are readily available. While the nature of such anions has no effect on the compositions and processes of this invention, chloride ion is the preferred counter-ion from an availability standpoint.

Binders may be desirable for inclusion in the fabric softening particles along with the quat clay and quaternary ammonium salts. When present, the binder concentration will range from about 0.1 to 20% by weight of the aggregate particle, preferably from about 0.5% to 10%, ideally from about 1% to 5%. The binder is a water-soluble or water-dispersible material, preferably organic, and will have a pH no higher than 10 and melting point between 85° and 150° F., preferably between 90° and 120° F. Binders may be selected from the group consisting of organic homopolymers or heteropolymers, organic nonionic compounds, long-chain $C_{10}$–$C_{22}$ fatty acids and fatty acid scaps, and mixtures thereof. Examples of suitable organic homo- or hetero polymers are modified starch, polyvinyl pyrrolidone, polyvinyl alcohol and sodium carboxymethyl cellulose. Suitable nonionic compounds are, for example, polyethylene glycols having a molecular weight of from 1,000 to 10,000; hydrocarbon waxes; $C_{15}$–$C_{24}$ fatty alcohols or $C_8$–$C_{12}$ alkyl phenyls having from about 10 to 60 ethylene oxide units; and the long-chain fatty acid alkylolamides, such as coconut fatty acid monoethanolamide. A particularly preferred polyethylene glycol is Carbowax 3350®, which is a homopolymer of ethylene oxide having molecular weight between 3000 and 3700 and melting point 129°-136° F., sold by the Union Carbide Corporation. Another particularly preferred binder is Neodol 45-13®, a $C_{14}$–$C_{15}$ fatty alcohol ethoxylated with an average of 13 moles ethylene oxide, and melting point about 90° F., sold by the Shell Chemical Company.

The aforedescribed fabric softening particles formed from quat clay and quaternary ammonium salt may be incorporated into detergent compositions. These may be liquid or powder products for washing fabrics. The detergent compositions are well known in the art. They generally comprise surfactants, builders and adjunct functional ingredients.

Organic surfactants may be incorporated into the detergent composition including anionic, nonionic, amphoteric, zwitterionic and mixed type surfactants. Surfactants may be present in an amount from about 2% to 50% by weight, preferably from 5% to 30% by weight.

Among the anionic surfactants are water-soluble salts of organic sulphur reaction products having in their molecular structure an alkyl radical containing from about 8 to about 22 carbon atoms and a radical selected from the group consisting of sulfonic acid and sulfuric acid ester radicals. Such surfactants are well known in the detergent art and are described at length in *Surface Active Agents and Detergents*, Vol. II, by Schwartz, Perry & Birch, Interscience Publishers, Inc., 1958, herein incorporated by reference. Illustrative of these surfactants are the salts of alkylbenzene sulfonates, alkyl sulfates, alkyl ether sulfates, paraffin sulfonates, α-olefin sulfonates, dialkyl sulphosuccinates and their esters, alkyl glycerol ether sulfonates, fatty acid monoglyceride sulfates and sulfonates, alkyl phenyl polyethoxy ether sulfates, 2-acyloxy-alkane-1-sulfonates and β-alkoxy alkane sulfonates. Soaps constituted from $C_8$–$C_{22}$ fatty acid salts of alkali metals are also suitable anionic surfactants.

Nonionic surfactants which may be included in the detergent compositions of this invention are water-soluble compounds produced by the condensation of an alkylene oxide with a hydrophobic compound such as an alcohol, alkylphenol, fatty acid, polypropoxy glycol or polypropoxy ethylene diamine. More specifically, the nonionics may be polyoxyethylene or polyoxypropylene condensates of $C_8$–$C_{24}$ aliphatic carboxylic acids, aliphatic alcohols or alkyl phenols. Appropriate concentrations for the nonionic surfactant range from about 2% to about 10% by weight of the total formulation.

The compositions of this invention will contain detergent builders. Useful builders can include any of the conventional inorganic and organic water-soluble builder salts. Typical of the well known inorganic builders are the sodium and potassium salts of the following: pyrophosphate, tripolyphosphate, orthophosphate, carbonate, bicarbonate, silicate, sesquicarbonate, borate and aluminosilicate. Among the organic detergent builders that can be used are the sodium and potassium salts of citric acid, nitrilotriacetic acid, carboxymethyloxy sulphosuccinic acid and vinyl polymers such as polyacrylate and polyacrylic/maleic acid copolymers. The detergent builders are generally used in a concentration range of from about 2% to about 80% by weight of the total formulation; preferably they are present from about 8% to about 60%; more preferably from about 20% to 60%.

Apart from detergent active compounds and builders, compositions of the present invention can contain all manner of minor additives commonly found in laundering or cleaning compositions in amounts in which such additives are normally employed. Examples of these additives include: lather boosters, such as alkanolamides, particularly the mono- and diethanolamides derived from palm kernel fatty acids and coconut fatty acids; lather depressants, such as alkyl phosphates, waxes and silicones; oxygen and chlorine bleaching agents; inorganic fillers; and usually present in very minor amounts, fabric whitening agents, perfumes, enzymes, germicides and colorants.

The following examples will illustrate certain aspects of the invention but are not limiting thereof. Unless otherwise stated, all parts, percentages and proportions are by weight.

EXAMPLE 1

Fabric softening particles of the present invention were prepared according to the following general process.

An aqueous solution of a binding agent was dissolved in water under agitation. Experiments were run with each of two different binding agents. These binders were Neodol 45-13®, an ethoxylated fatty alcohol from the Shell Chemical Company and Carbowax 3350®, from the Union Carbide Corporation. The water containing the binding agent was heated to approximately 140° F. to aid dissolution. After dissolution, a colorant was added and mixing continued for about another 15 minutes.

Softening actives, Bentone 34® and Arosurf TA-100®, were each charged to a Marion Mixer. Arosurf TA-100® is dimethyl distearyl ammonium chloride, manufactured by the Sherex Chemical Company. After the Bentone 34® and Arosurf TA-100® had been mixed for a short period of time, the binding solution was then sprayed onto the aforementioned solid components by means of a Unijet nozzle (Spraying Systems Company). Subsequent to spraying the solution, the resultant agglomerated powder was allowed to mix for an additional 45 minutes. The agglomerated powder was then stored in a vented container and allowed to age several days until equilibration of the moisture level.

Agglomerates produced with Carbowax 3350® exhibited a wide particle distribution. A significant portion (>15% by weight) of the batch required milling or grinding. Batches using Neodol 45-13® as the sole binding agent, produced a narrow particle size distribution. The entire batch could pass through a U.S. sieve No. 10 screen without milling or grinding.

Softening particle compositions made by the described process are listed in Table I. Typical properties of these powders are detailed in Table II. For instance, the dynamic flow rate (DFR) is listed which characterizes the powder flow quality; values above 100 ml/sec are considered reflective of good free-flow properties while those substantially below this value flow poorly. Measurement of DFR is more fully described in U.S. Pat. No. 4,473,485 incorporated herein by reference.

TABLE I

| | Compositions of Fabric Softening Powders | | | | |
|---|---|---|---|---|---|
| Sample No.: | 1 | 2 | 3 | 4 | 5 |
| Bentone 34 ® | 42.415% | 42.485% | 39.62% | 46.455% | 41.565% |
| Arosurf TA-100 ® | 42.415% | 42.485% | 39.62% | 46.455% | 41.565% |
| Neodol 45-13 ® | — | 0.86% | 1.6% | — | 0.85% |
| Carbowax 3350 ® | — | — | — | 1.9% | 0.85% |
| Colorant | 0.17% | 0.17% | 0.16% | 0.19% | 0.17% |
| Water | 15% | 14% | 19% | 5% | 15% |

TABLE II

| | Powder Properties | | | | |
|---|---|---|---|---|---|
| Sample No.: | 1 | 2 | 3 | 4 | 5 |
| Additives (basis dry agglomerate weight) | None | 1% Neodol 45-13 ® | 2% Neodol 45-13 ® | 2% Carbowax 3550 ® | 1% Neodol 45-13 ® 1% Carbowax 3550 ® |
| Density (g/l) | 477 | 527 | 560 | 563 | 559 |
| Moisture (%) | 15 | 14 | 19 | 5 | 15 |
| DFR (ml/sec) | 65 | 120 | 112 | 115 | 100 |
| Compressibility (%) | 24 | 15 | 20 | 11 | 21 |
| $\bar{x}$ (mean particle size in microns) | 395 | 714 | 879 | 709 | 978 |
| N (distribution coefficient; higher values relect narrower particle distribution) | 1.57 | 2.31 | 3.41 | 1.81 | 1.44 |

EXAMPLE 2

Detergent compositions containing the fabric softening particles of the present invention were evaluated using a standard fabric softening test. This test measures the relative effectiveness of products containing fabric softening material to impart a soft feel or hand to fabrics. Full scale evaluations were performed in a top-loading washing machine containing typical loads at detergent useage levels for high suds powders (1.6 g/l). Terry towel fabric was included to assess softeness. Edgewater tap water (120–130 ppm hardness) at 100° F. was generally used for the test. All tests were done in triplicate for statistical purposes.

Preliminary determinations of softness were run on sample cloth in a Terg-o-tometer apparatus under conditions similar to that of the larger scale washing machine loads. Cloth to wash solution ratio (23:1) was kept identical to that used with the washing machines. Edgewater tap water (1000 ml) of previously specified hardness was used at 100° F. Wash times were 15 minutes at 90 cpm speed. Two rinses were performed at 3 minutes each. The foregoing wash sequence, each followed by line or dryer drying, was repeated for a total of 4 times. The test pieces were six terry towel swatches of 4 inch×6 inch dimension.

Relative softness imparted to the cloths by the test products were assessed by a ten member panel comprised of technicians and graduates experienced in softness evaluations. Panelists were asked to assess only three test pieces at any one time to minimize loss of discrimination.

Each panelist was asked to assign a relative score and absolute grade to each test piece from the washing machine or from the 6 pieces from the Terg-o-tometer pot. The scores reported by the panelists were averaged. They are here reported as "comparative" softening for relating rank and "absolute" softening graded on a 1 to 5 scale, lowest number best.

The base detergent powder employed for the fabric softening evaluations is listed below.

TABLE III

| Base Powder (A) | |
|---|---|
| Component | Weight % |
| Linear alkylbenzene sulfonate | 16.0 |
| Sodium tripolyphosphate | 34.0 |
| Sodium carbonate | 10.0 |
| Sodium silicate | 8.0 |
| Sodium sulfate | 21.0 |
| Minor detergent adjuncts and water | to 100% |

Base powder (A) in an amount of 95% was mixed with 5% of softener adjunct particles. Formulation 1 contained base powder (A) and 5% Bentone 34®. Formulation 2 contained 5% of a 1:1 mixture Arosurf TA-100® and Bentone 34® combination. Formulation 3 contained base powder (A) with 5% Arosurf TA-100®. As seen in Table V, formulation 2 combining both Arosurf TA-100® and Bentone 34® softened better than either of the components separately. The order of softness was seen both on a comparative and an absolute scale.

TABLE IV

| Detergent Compositions With Softener Formulations | | | |
|---|---|---|---|
| Formulation | Base Powder (A) | Bentone 34 ® | Arosurf TA-100 ® |
| 1 | 95% | 5% | — |
| 2 | 95% | 2.5% | 2.5% |
| 3 | 95% | — | 5% |

TABLE V

| Line Dried Terry Cloths 4× Softening Assessment Totals | | | | | | | |
|---|---|---|---|---|---|---|---|
| | Softening Totals* | | | | | | |
| | Comparative | | | | Absolute | | |
| Formulation | 1 | 2 | 3 | | 1 | 2 | 3 |
| Score | 22 | 8 | 18 | Grade | 3.2 | 1.9 | 2.4 |
| Rank | 2 > 3 > 1 | | | | 2 > 3 > 1 | | |

*Legend:
Comparative Rank
1 = Best softening
2 = Intermediate
3 = Poorest softening
Absolute Grading
1 = Very soft
2 = Soft
3 = Fair
4 = Harsh
5 = Very harsh

EXAMPLE 4

This example illustrates the softening effect of various ratios of Arosurf TA-100® to Bentone 34® in base powder (A). The results from the assessment are summarized in Table VI. It is seen that the 1:1 blend of Arosurf TA-100®:Bentone 34® performs better than the 3:1 and 1:3 ratios.

TABLE VI

| Detergent Compositions With Softener Formulations | | | |
|---|---|---|---|
| Formulation | Base Powder (A) | Bentone 34 ® | Arosurf TA-100 ® |
| 2 | 95% | 2.5% | 2.5% |
| 3 | 95% | 1.25% | 3.75% |
| 4 | 95% | 3.75% | 1.25% |

TABLE VII

| Line and Dryer Dried Terry Cloth 1× Softening Totals | | | | | | |
|---|---|---|---|---|---|---|
| | Comparative | | | | | |
| Rank | Dryer 2 > 4 > 3 | | | Line-Dried 2 > 4 > 3 | | |
| | Absolute | | | | | |
| | Dryer | | | Line Dried | | |
| Formulation | 2 | 3 | 4 | 2 | 3 | 4 |
| Grade | 2.1 | 2.4 | 2.3 | 2.3 | 2.7 | 2.4 |

From Table VII it will be observed that the best dryer and line dry balance is achieved with a 1:1 blend of Arosurf TA-100®:Bentone 34®.

EXAMPLE 5

Further data is here provided demonstrating the softening effects of particles with different ratios Arosurf TA-100® to Bentone 34® in base powder (A). Determinations of softness were conducted as described in Example 2 and identical to Example 4 except that the particle use level was increased from 1.6 g/l to 2.0 g/l. The difference in use level is believed to be insignificant with regard to comparison between the results of Example 4 and the present data.

TABLE VIII

| Detergent Compositions with Softener Formulations | | | |
|---|---|---|---|
| Formulation | Base Powder (A) | Bentone 34 ® | Arosurf TA-100 ® |
| 5 | 95% | 1.0% | 4.0% |
| 6 | 95% | 1.25% | 3.75% |
| 7 | 95% | 4.0% | 1.0% |
| 8 | 95% | 3.75% | 1.25% |

TABLE IX

| Dryer Dried Terry Cloth 1× Softening Totals | | | | |
|---|---|---|---|---|
| | Comparative | | | |
| Rank | 6 > 5 | | 8 > 7 | |
| | Absolute | | | |
| Formulation | 5 | 6 | 7 | 8 |
| Grade | 2.87 | 2.1 | 2.7 | 2.47 |

From Table IX, is will be observed that formulations 6 and 8 (1:3 and 3:1 ratio) were judged to be significantly softer than formulations 5 and 7 (1:4 and 4:1 ratio), respectively. These ratings were both found on an absolute and comparative scale. Accordingly, it appears that the outer limits of the present invention would be Bentone 34® to Arosurf TA-100® proportions of 3:1 to 1:3.

EXAMPLE 6

The detergency effects of fabric softening particles of the present invention are herewith reported. Compositions using base powder (A) were formulated as detailed in Table X. Detergency of these formulations was evaluated in a Terg-o-tometer under conditions identical to that described in

TABLE X

| Detergent Compositions with Softening Formulations | | | | |
|---|---|---|---|---|
| Formulation | Base Powder (A) | Bentone 34 ® | Arosurf TA-100 ® | Sodium Sulfate |
| 9 | 95% | — | — | 5.0% |
| 10 | 95% | 5.0% | — | — |
| 11 | 95% | — | 5.0% | — |
| 12 | 95% | 2.5% | 2.5% | — |

TABLE XI

| Detergency Results | | |
|---|---|---|
| | % Detergency | |
| Formulation | Vacuum Cleaner Dust Soil | Lever Clay Soil |
| I. Conditions Water hardness - 150 ppm Water temperature - 100° F. | | |
| 9 | 44.1 | 47.0 |
| 10 | 35.4 | 38.7 |
| 11 | 41.1 | 34.0 |
| 12 | 41.0 | 46.3 |
| II. Conditions Water hardness - 125 ppm Water temperature - 100° F. | | |
| 9 | 47.6 | 55.5 |
| 10 | 38.7 | 52.6 |
| 11 | 45.3 | 49.6 |
| 12 | 45.8 | 54.6 |

It can be seen from Table XI that the presence of Bentone 34® and Arosurf TA-100® at best allows detergency equivalent to that of formulations where the fabric softener particles are absent. Formulation 10 with Bentone 34® exhibits inferior detergency against vacuum cleaner dust in comparison with the control formulation 9. Against clay soil, both the Bentone 34® formulation 10 and Arosurf TA-100® formulation 11 have inferior detergency relative to the control composition. A combination of Bentone 34® and Arosurf TA-100® unexpectedly permits detergency not substantially inferior to that of the control.

The foregoing description and Examples illustrate selected embodiments of the present invention and in light thereof variations and modifications will be suggested to one skilled in the art, all of which are in the spirit and purview of this invention.

What is claimed is:

1. A fabric softening particle comprising:

(i) a clay having an ion-exchange capacity of at least about 50 meq/100 grams, in which clay from about 5 to 100 molar percent of the exchangeable cations are water insoluble quaternary ammonium ions of the formula $[R_1R_2R_3R_4N]^+$ wherein $R_1$, $R_2$, $R_3$ and $R_4$ are organic radicals selected from the group consisting of $C_1$–$C_{22}$ alkyl, benzyl, $C_{10}$–$C_{16}$ alkyl benzyl, $C_{10}$–$C_{16}$ alkyl phenyl, $C_2$–$C_4$ hydroxyalkyl, cyclic structures in which nitrogen forms part of a ring, and mixtures thereof; and (ii) a water-insoluble quaternary ammonium salt of the formula $[R_1R_2R_3R_4N]^+{}_nX^{n-}$ wherein $R_1$, $R_2$, $R_3$ and $R_4$ are organic radicals as defined above; X can be any salt forming anion; n is an integer from 1 to 3; and the ratio of (i) to (ii) is 3:1 to 1:3.

2. A fabric softening particle according to claim 1 further comprising a water-soluble or water-dispersible binder present in an amount from about 0.1 to 20%.

3. A fabric softening particle according to claim 2 wherein the amount of said binder is from about 0.5%, to 10%.

4. A fabric softening particle according to claim 2 wherein the binder is selected from the group consisting of organic homo- or hetero polymers, organic nonionic compounds, longchain $C_{10}$–$C_{22}$ fatty acids and fatty acid soaps, and mixtures 5. A fabric softening particle according to claim 4 wherein the organic nonionic binder is selected from the group consisting of polyethylene glycols, $C_{15}$–$C_{24}$ fatty alcohols or $C_8$–$C_{12}$ alkyl phenyls having from about 10 to 60 ethylene oxide units, and long-chain fatty acids alkylolamides.

6. A fabric softening particle according to claim 1 wherein the ratio of (i) to (ii) is about 1:1.

7. A fabric softening particle according to claim 1 wherein said water-insoluble quaternary ammonium salt is a distearyl dimethyl ammonium salt.

8. A fabric softening particle according to claim 1 wherein said clay is of the montmorillonite type.

9. A fabric softening particle according to claim 1 wherein the exchanged quaternary ammonium cations are dihydrogenated ditallow dimethyl ammonium ions.

10. A detergent composition comprising:

(i) from 0.1% to 20% of fabric softening particles according to claim 1;

(ii) from 2% to 50% of a surfactant; and (iii) from 2% to 80% of a builder.

11. A detergent composition according to claim 10 wherein said surfactant is selected from the group consisting of anionic, nonionic, zwitterionic, amphoteric and surfactant mixtures thereof.

12. A detergent composition according to claim 10 further comprising from 0.01% to 50% of detergent adjuncts selected from the group consisting of fillers, foam boosters and controllers, colorants, anti-redeposition agents, buffers, fluorescent whitening agents, bleaching agents and their activators, anti-tarnishing agents, perfumes, germicides and mixtures thereof.

13. A detergent composition according to claim 10 comprising:

(i) from about 3% to 10% of fabric softening particles according to claim 1;

(ii) from 5% to 20% of an anionic surfactant; and (iii) from 20% to 60% of a builder.

14. A fabric softening particle comprising:

(i) a clay having an ion-exchange capacity of at least about 10 meq/100 grams, in which clay from about 5 to 100 molar percent of the exchangeable cations are quaternary ammonium ions of the formula $[R_1R_2R_3R_4N]^+$ wherein $R_1$, $R_2$, $R_3$ and $R_4$ are organic radicals selected from the group consisting of $C_1$–$C_{22}$ alkyl, benzyl, $C_{10}$–$C_{16}$ alkyl benzyl, $C_{10}$–$C_{16}$ alkyl phenyl, $C_2$–$C_4$ hydroxyalkyl, cyclic structures in which nitrogen forms part of a ring, and mixtures thereof; and (ii) a water-insoluble quaternary ammonium salt of the formula $[R_1R_2R_3R_4N]^+{}_nX^{n-}$ wherein $R_1$, $R_2$, $R_3$ and $R_4$ are organic radicals as defined above; x can be any salt forming anion; n is an integer from 1 to 3; and the ratio of (i) to (ii) is 3:1 to, 1:3.

15. A fabric softening particle according to claim 14 wherein the ion-exchange capacity is at least about 30 meq/100 grams.

* * * * *

UNITED STATES PATENT AND TRADEMARK OFFICE

CERTIFICATE OF CORRECTION

PATENT NO. : 4,764,292

DATED : August 16, 1988

INVENTOR(S) : Sepulveda et al.

It is certified that error appears in the above—identified patent and that said Letters Patent is hereby corrected as shown below:

Column 5, line 46, "scaps" should read -- soaps --.

Column 8, line 37, under Table II, "relect" should read -- reflect --.

Column 10, line 55, "is" should read -- it --.

Signed and Sealed this

Twenty-fifth Day of October, 1988

*Attest:*

DONALD J. QUIGG

*Attesting Officer*

*Commissioner of Patents and Trademarks*